US011892181B2

(12) United States Patent
Ikari et al.

(10) Patent No.: US 11,892,181 B2
(45) Date of Patent: Feb. 6, 2024

(54) HVAC SYSTEM WITH INTEGRATED SUPPLY OF OUTDOOR AIR

(71) Applicant: Goodman Manufacturing Company, L.P., Waller, TX (US)

(72) Inventors: Kazuki Ikari, Houston, TX (US); Keitaro Hoshika, Houston, TX (US); Hideyuki Nakagawa, Houston, TX (US); Masahiro Honda, Cypress, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 0 days.

(21) Appl. No.: 17/674,343

(22) Filed: Feb. 17, 2022

(65) Prior Publication Data

US 2023/0258349 A1 Aug. 17, 2023

(51) Int. Cl.
*F24F 11/62* (2018.01)
*F24F 11/32* (2018.01)
*F24F 11/58* (2018.01)

(52) U.S. Cl.
CPC ..... *F24F 11/32* (2018.01); *F24F 11/58* (2018.01); *F24F 11/62* (2018.01)

(58) Field of Classification Search
CPC ..... F24F 11/62
See application file for complete search history.

(56) References Cited

U.S. PATENT DOCUMENTS 5,551,248 A * 9/1996 Derosier ..... F24F 11/38 62/181
9,410,715 B2 8/2016 Honda et al.
10,557,643 B2 2/2020 Nelson
10,948,208 B2 3/2021 Oka et al.
(Continued)

FOREIGN PATENT DOCUMENTS

CN 111536603 A 8/2020
KR 10-1604317 B1 * 3/2016
KR 1020210033182 A 3/2021

OTHER PUBLICATIONS

"Gold System Application LG VRF," webpage at http://swegonnorthamerica.com/wp-content/uploads/2017/09/GSA_LG_001.pdf, Sep. 2017, Swegon North America, Toronto, Canada (1 page).

(Continued)

*Primary Examiner* — Michael W Choi
(74) *Attorney, Agent, or Firm* — Eubanks PLLC

(57) ABSTRACT

An HVAC system with an integrated source of outdoor air is provided. In one embodiment, an HVAC system includes an outdoor unit, having a compressor and a heat exchanger, and a ventilation unit to receive and provide outdoor air to a structure. The ventilation unit has a blower, a dehumidifying coil, and a reheat coil installed in a housing. The HVAC system also includes a first electronic expansion valve coupled outside the housing of the ventilation unit to control refrigerant flow into the dehumidifying coil and a second electronic expansion valve coupled outside the hous- (Continued)

ing of the ventilation unit to control refrigerant flow into the reheat coil. An electronic expansion valve controller is connected to control operation of the first electronic expansion valve and the second electronic expansion valve. Additional systems, devices, and methods are also disclosed.

22 Claims, 6 Drawing Sheets

(56) References Cited

U.S. PATENT DOCUMENTS

| | | | | |
|---|---|---|---|---|
| 11,215,371 | B2 | 1/2022 | O'Brian | |
| 11,243,003 | B2 | 2/2022 | Moffitt | |
| 2015/0027151 | A1 | 1/2015 | Cur et al. | |
| 2016/0097568 | A1 | 4/2016 | Korenaga | |
| 2016/0245536 | A1* | 8/2016 | Iwasaki | F25B 49/02 |
| 2017/0108231 | A1 | 4/2017 | Hasegawa et al. | |
| 2017/0307246 | A1* | 10/2017 | Ohara | F24F 11/58 |
| 2019/0154281 | A1 | 5/2019 | Rosenblum et al. | |
| 2019/0226692 | A1 | 7/2019 | Yamada et al. | |
| 2020/0309438 | A1* | 10/2020 | Dusenbury | F25B 49/025 |
| 2020/0386433 | A1 | 12/2020 | Honda et al. | |
| 2021/0180818 | A1 | 6/2021 | Oka et al. | |
| 2021/0239377 | A1* | 8/2021 | Kim | F25B 41/20 |
| 2022/0010978 | A1* | 1/2022 | Day | F24D 19/00 |
| 2022/0178575 | A1* | 6/2022 | Lee | F24F 11/0001 |

OTHER PUBLICATIONS

"Gold System Application Mitsubishi Electric VRF," webpage at http://swegonnorthamerica.com/wp-content/uploads/2017/09/GSA_MITS_001.pdf, Sep. 2017, Swegon North America, Toronto, Canada (1 page).

* cited by examiner

HVAC SYSTEM WITH INTEGRATED SUPPLY OF OUTDOOR AIR

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Modern residential, commercial, and industrial customers expect indoor spaces to be climate controlled. Heating, ventilation, and air conditioning ("HVAC") systems often circulate an indoor space's air over low-temperature (for cooling) or high-temperature (for heating) sources, thereby adjusting the indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat. Within a typical HVAC system, a fluid refrigerant circulates through a closed loop of tubing that uses a compressor and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air.

In some instances, an HVAC system is a split system having indoor and outdoor units, each having a heat exchanger, connected in fluid communication. As would be expected in such cases, the heat exchanger providing heating or cooling to the climate-controlled space or structure is described adjectivally as being "indoors," and the heat exchanger transferring heat with the surrounding outdoor environment is described as being "outdoors." The refrigerant circulating between the indoor and outdoor heat exchangers—transitioning between phases along the way—absorbs heat from one location and releases it to the other. Those in the HVAC industry describe this cycle of absorbing and releasing heat as "pumping." To cool the climate-controlled indoor space, heat is "pumped" from the indoor side to the outdoor side. And the indoor space is heated by doing the opposite, pumping heat from the outdoors to the indoors.

An HVAC system may also provide outdoor air into a structure for ventilation. In some instances, an HVAC system includes a ventilation unit, such as a dedicated outdoor air system, for delivering outdoor air to indoor spaces. The humidity of the outdoor air provided by the HVAC system to the indoor spaces may be controlled to improve indoor air quality and comfort.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to HVAC systems that provide outdoor air to indoor spaces for ventilation. More specifically, some embodiments relate to an HVAC system having electronic expansion valves and an associated electronic expansion valve controller that facilitate use of a ventilation unit with an outdoor unit. In some instances, the electronic expansion valves and associated controller enable connection between a ventilation unit made by one manufacturer and a variable refrigerant flow outdoor unit made by a different manufacturer.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
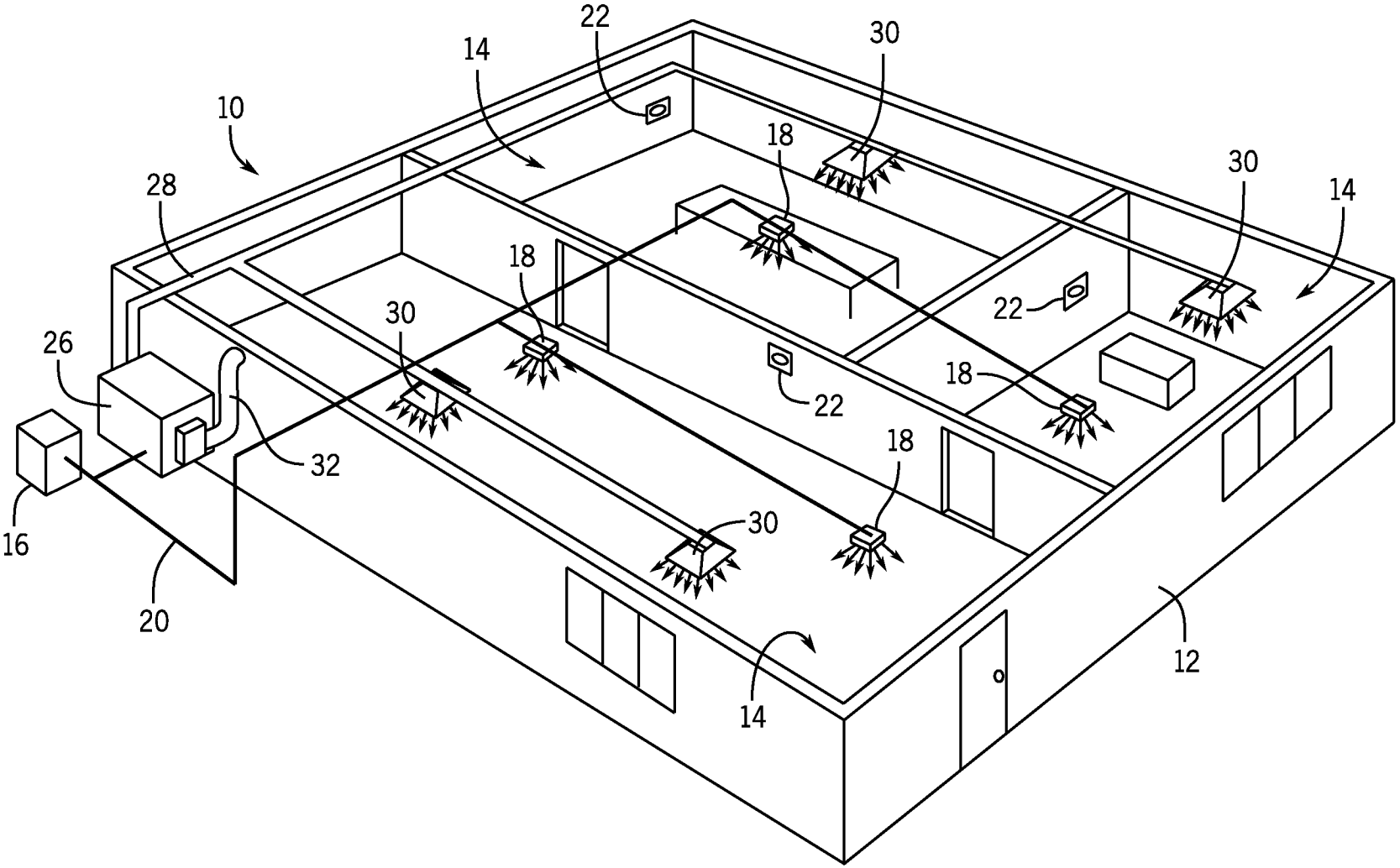
FIG. 1 illustrates schematically an HVAC system for heating, cooling, and providing outdoor air to indoor spaces within a structure in accordance with one embodiment of the present disclosure.

By way of example, and turning now the figures, FIG. 1 illustrates a split HVAC system 10 in accordance with one embodiment. As depicted, the system 10 provides heating and cooling for a commercial structure 12. But the concepts disclosed herein are applicable to a myriad of heating and cooling situations, including industrial and residential settings. And while some HVAC systems provide each of heating, ventilation, and air conditioning, others do not. The term "HVAC system," as used herein, means a system that provides one or more of heating, ventilation, air conditioning, or refrigeration. For example, an air conditioner that does not provide heating or ventilation is considered an HVAC system. The use of the term "HVAC" in describing a system, unit, component, equipment, etc., herein is not to be interpreted as a requirement that each of heating, ventilation, and air conditioning is provided.

Many North American residences, as well as some commercial and industrial buildings, employ "ducted" systems, in which a structure's ambient air is circulated over a central indoor heat exchanger and then routed back through relatively large ducts (or ductwork) to multiple climate-controlled indoor spaces. However, the use of a central heat exchanger can limit the ducted system's ability to vary the temperature of the multiple indoor spaces to meet different occupants' needs. This is often resolved by increasing the number of separate systems within the structure—with each system having its own outdoor unit that takes up space on the structure's property, which may not be available or at a premium.

Some buildings also or instead employ "ductless" systems, in which refrigerant is circulated between an outdoor unit and one or more indoor units to heat and cool specific indoor spaces. Unlike ducted systems, ductless systems route conditioned air to the indoor space directly from the indoor unit—without ductwork.

The described HVAC system 10 of FIG. 1 includes a split system with an outdoor unit 16, which mainly comprises components for transferring heat with the environment outside the structure 12, and indoor units 18, which mainly comprise components for transferring heat with the air inside the structure 12. In the illustrated structure, the indoor units 18 are ductless indoor units that provide heating and cooling to various indoor spaces 14. In other embodiments, however, the HVAC system 10 could also or instead include a ducted indoor unit. Fluid refrigerant circulates between the outdoor unit 16 and the indoor units 18 through a network 20 of refrigerant lines generally depicted in FIG. 1.

The HVAC system 10 of FIG. 1 includes thermostats 22. Each thermostat 22 can sense an indoor space's temperature and allows the structure occupants to "set" the desired temperature for that sensed indoor space 14. The thermostat may operate using a simple on/off protocol that sends 24V signals, for example, to the HVAC system to either activate or deactivate various components; or it may be a more complex thermostat that uses a "communicating protocol," such as ClimateTalk or a proprietary protocol, that sends and receives data signals and can provide more complex operating instructions to the HVAC system 10.

The depicted HVAC system 10 also includes a ventilation unit 26 that provides outdoor air to the interior of the structure 12. The ventilation unit 26 includes an air handler and, in at least some instances, may be a dedicated outdoor-air supply (DOAS) air handler unit or an outdoor-air processing unit. As shown in FIG. 1, the ventilation unit 26 is an outdoor DOAS air handler unit that receives outdoor air and provides that outdoor air to indoor spaces 14 of the structure 12, such as through supply ductwork 28 and outlets 30 (e.g., diffusers). An outdoor ventilation unit 26 can be installed at any suitable location, such as on the ground or on a roof of the structure 12. In other instances, one or more ventilation units 26 may also or instead be installed at an indoor location, such as in a mechanical room of a commercial structure or in a ceiling void space (e.g., above a suspended ceiling) in a structure.

In certain embodiments, the ventilation unit 26 provides outdoor air mixed with return air from inside the structure (e.g., air passing from an indoor space 14 through return ductwork 32). As an example, the ventilation unit 26 can include a mixing box with one or more louvers that control the amount of indoor air that is mixed with the outdoor air. In other instances, the ventilation unit 26 provides only outdoor air to the indoor spaces 14. The ductwork 28 and 32 can include rigid or flexible ducts.

Fluid refrigerant circulates between the outdoor unit 16 and the ventilation unit 26 through the network 20 of refrigerant lines generally depicted in FIG. 1. Although the same outdoor unit 16 supplies compressed refrigerant to the indoor units 18 and the ventilation unit 26 in the HVAC system 10 of FIG. 1, it will be appreciated that the HVAC system 10 may include multiple outdoor units 16 in other embodiments. In some cases, for instance, the HVAC system 10 may include comfort and ventilation refrigerant circuits supplied by separate outdoor units 16, such as a comfort refrigerant circuit having one or more outdoor units 16 connected to provide refrigerant to indoor units 18 and an independent ventilation refrigerant circuit having one or more other outdoor units 16 connected to provide refrigerant to one or more ventilation units 26.

Figure 2:
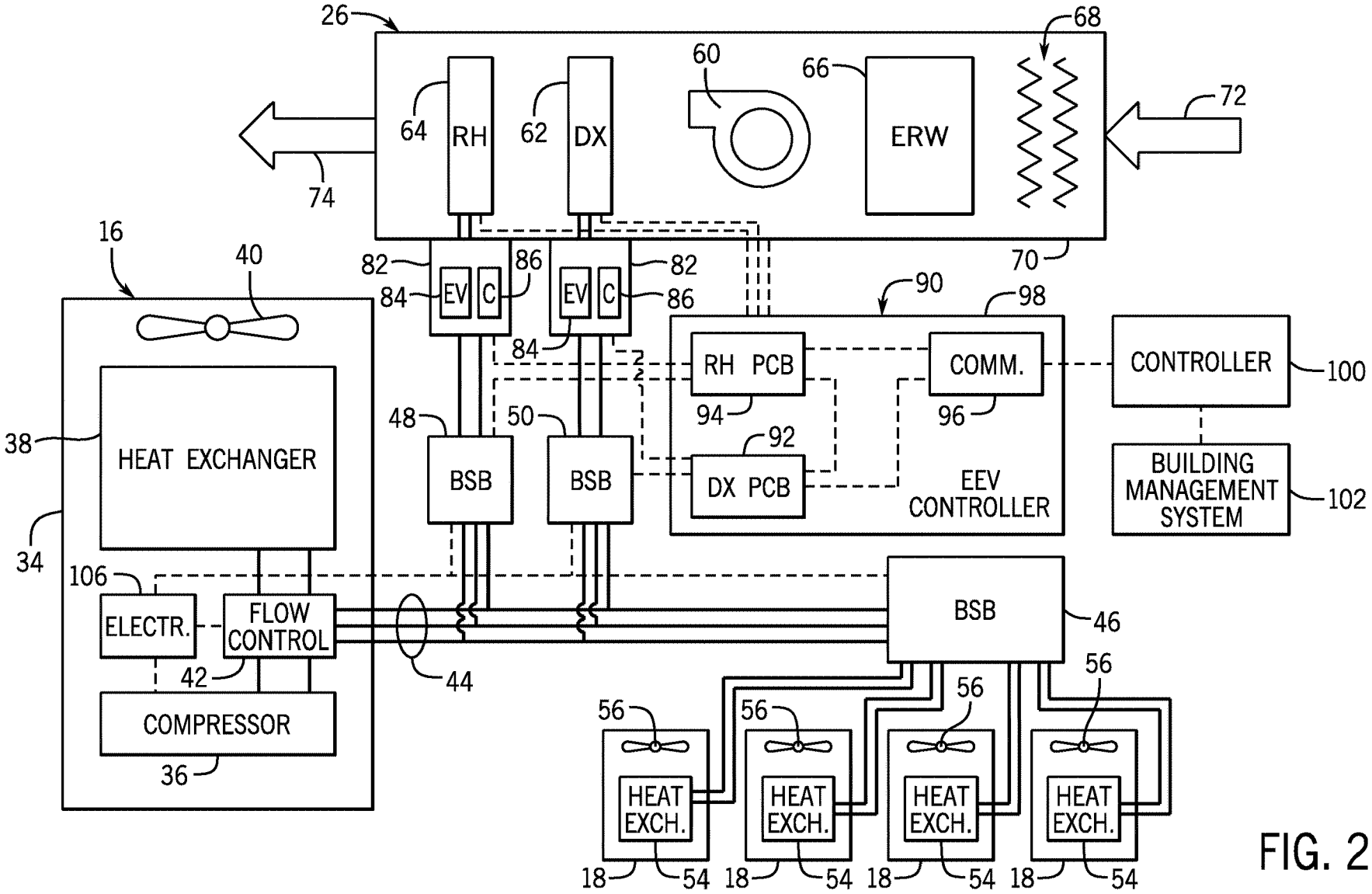
FIG. 2 is a schematic process-and-instrumentation drawing of an HVAC system for heating, cooling, and ventilating indoor spaces within a structure, the HVAC system including electronic expansion valves and an electronic expansion valve controller for controlling refrigerant flow to heat exchangers of a ventilation unit, in accordance with one embodiment.

As shown in FIG. 2, the outdoor unit 16 includes a compressor 36 and a heat exchanger 38 installed in a casing housing 34, such as a metal or plastic housing. The compressor 36 compresses fluid refrigerant and motivates circulation of the refrigerant to other units, such as the indoor units 18 and the ventilation unit 26. A fan 40 promotes airflow across the heat exchanger 38 to facilitate heat transfer between the outdoor air and the heat exchanger 38. The outdoor unit 16 may be an up-flow unit, with the fan 40 generating airflow discharged from the outdoor unit 16 in an upward direction (e.g., perpendicular to the ground), or a side-flow unit in which the fan 40 is arranged to discharge air from a side of the outdoor unit 16 (e.g., parallel to the ground). In some embodiments, the outdoor unit 16 includes multiple compressors 36, heat exchangers 38, and fans 40. The outdoor unit 16 can also include flow-control devices 42 (e.g., four-way valves) to direct refrigerant flow between components of the HVAC system 10.

As also shown in FIG. 2, the HVAC system 10 includes branch selector boxes 46, 48, and 50 for routing refrigerant among the outdoor unit 16, the indoor units 18, and the ventilation unit 26. In this depicted example, the HVAC system 10 is a "three-pipe" variable refrigerant flow system, in which the network 20 of refrigerant lines include three refrigerant lines 44 that connect the outdoor unit 16 to the branch selector boxes 46, 48, and 50. These three refrigerant lines 44 can include a liquid line that carries predominantly liquid refrigerant (e.g., high-pressure liquid refrigerant for cooling), a discharge line that carries predominately gas refrigerant (e.g., high-pressure hot gas for heating), and a gas line that carries predominately gas refrigerant (e.g., low-pressure gas returning to the outdoor unit). In other instances, the HVAC system 10 could be provided as a "two-pipe" system with just a liquid line and a gas line.

The branch selector boxes 46, 48, and 50 direct liquid refrigerant or gas refrigerant to connected units for cooling or heating. For instance, in FIG. 2 the branch selector box 46 is a multi-port branch selector that controls flow of refrigerant to multiple indoor units 18, which each include a heat exchanger 54 and a fan 56. The fan 56 generates airflow that draws ambient air from an indoor space 14 into the indoor unit 18, passes that air across the heat exchanger 54, and discharges the air into the indoor space 14. The multiple indoor units 18 may also include additional components, such as an expansion valve (or other refrigerant metering device) and electrical control circuity.

For cooling an indoor space 14 with an indoor unit 18, liquid refrigerant may flow from the branch selector box 46 to the heat exchanger 54 of the indoor unit 18 to absorb heat from airflow generated by the fan 56 across the heat exchanger 54. For heating, hot gas refrigerant may flow from the branch selector box 46 to a heat exchanger 54 of an indoor unit 18 to add heat to airflow generated by the fan 56 across the heat exchanger 54. In some instances, the indoor units 18 may be operated in different modes simultaneously. That is, one or more of the indoor units 18 may be operated in a cooling mode while at least one of the other indoor units 18 is operated in a heating mode.

The branch selector boxes 48 and 50 of FIG. 2 route flow of refrigerant to the ventilation unit 26. Although depicted with two single-port branch selector boxes 48 and 50, the HVAC system 10 could use a single multi-port branch selector box in place of the single-port branch selector boxes 48 and 50. The ventilation unit 26 is depicted in FIG. 2 as an air handler having a blower 60 and heat exchangers 62 and 64 installed in a housing 70. In this embodiment, the heat exchanger 62 is a dehumidifying (DX) coil and the heat exchanger 64 is a reheat (RH) coil. The blower 60 provides airflow circulation through the housing 70, drawing incoming air into the housing 70 (generally represented by arrow 72), passing the air across the dehumidifying coil 62 and the reheat coil 64, and then discharging outgoing air from the housing 70 (as generally represented by arrow 74) into an indoor space. For a ventilation unit 26 providing outdoor air to a structure, the incoming air 70 may be outdoor air only or a mixture of outdoor and indoor air, as discussed above.

Refrigerant may be passed through the dehumidifying coil 62 and the reheat coil 64 to condition air flowing through the housing 70. More particularly, the dehumidifying coil 62 can be used as a cooling coil to decrease humidity of the flowing air by lowering its temperature to remove moisture through condensation (i.e., by chilling the air passing the dehumidifying coil 62 to a temperature below the dew point of the incoming air). This dehumidified air then passes across the reheat coil 64, which can be operated to raise the temperature of the flowing air before discharge from the housing 70. The reheat coil 64 can be used to heat the flowing air to various temperatures, but in some embodiments the reheat coil 64 heats the chilled, dehumidified air to a neutral temperature, such as 65-75° F. (18-24° C.) that may be comfortable for occupants of the structure 12.

The ventilation unit 26 may also include additional components. As shown in FIG. 2, for instance, the ventilation unit 26 includes an energy recovery wheel 66 and a preheat device 68, such as an electric heating coil, installed in the housing 70. The ventilation unit 26 can also include electrical control circuitry and various sensors, examples of which include thermistors or other temperature sensors, pressure sensors, relative humidity sensors, and carbon dioxide sensors. One or more filters may also be provided in the housing 70 to filter air flowing through the ventilation unit 26.

In some instances, an HVAC system 10 includes an outdoor unit 16 and a ventilation unit 26 that are made by the same manufacturer. In others, however, the outdoor unit 16 and the ventilation unit 26 are made by different manufacturers. In at least some embodiments of the present technique, the HVAC system 10 includes an electronic expansion valve (EEV) controller 90 that controls operation of electronic expansion valves that control flow of refrigerant into the dehumidifying coil 62 and the reheat coil 64. This allows use of an outdoor unit 16 made by one manufacturer with a ventilation unit 26 made by either the same manufacturer or a different manufacturer. Because the EEV controller 90 and the electronic expansion valves controlling refrigerant into the dehumidifying coil 62 and the reheat coil 64 enable integration of a ventilation unit 26 from one manufacturer into an HVAC system 10 with an outdoor unit 16 from a different manufacturer, these electronic expansion valves and the EEV controller 90 may be considered an expansion valve adapter kit.

The desired operating parameters and component characteristics of the HVAC system 10 may vary based on the purpose and location of the ventilated structure. For instance, an HVAC system in a humid place may benefit from a large dehumidification capacity and use a large dehumidifying coil 62, while an HVAC system in a dry place may be designed with a smaller dehumidification capacity and dehumidifying coil 62. Assorted options may be included in ventilation units, some of which may not be useful or desirable in certain conditions. The EEV controller 90 and associated electronic expansion valves facilitate connection of a wide array of ventilation units 26 from various manufacturers to an outdoor unit 16, allowing selection of a ventilation unit 26 that is more particularly suited to a given set of design conditions and applications.

To facilitate use with a third-party ventilation unit 26 (i.e., a ventilation unit made by a manufacturer that did not make the outdoor unit 16), the HVAC system 10 is shown in FIG. 2 as having valve boxes 82 that are distinct from, and are positioned outside of, the housing 70 of the ventilation unit 26. Refrigerant from the branch selector box 50 is routed to the dehumidifying coil 62 through an electronic expansion valve 84 of one valve box 82, and refrigerant from the branch selector box 48 is routed to the reheat coil 64 through an electronic expansion valve 84 of another valve box 82. Each depicted valve box 82 can also include valve control circuity 86 to open and close the associated electronic expansion valve 84 (e.g., with a stepper motor of the valve 84). This allows the electronic expansion valve 84 to control the flow of refrigerant between the branch selector box 50 (or 48) and the coil 62 (or 64) to which the electronic expansion valve 84 is connected.

Although refrigerant lines are generically shown in FIG. 2 connecting the valve boxes 82 to the branch selector boxes 48 and 50 and to the coils 62 and 64, it is noted that refrigerant lines may be connected between the branch selector boxes 48 and 50, the valve boxes 82, and the coils 62 and 64 in any suitable manner. In at least some embodiments, this includes having a refrigerant line that connects the branch selector box 50 to its associated valve box 82, another refrigerant line that connects the valve box 82 to the dehumidifying coil 62, and an additional refrigerant line that connects the dehumidifying coil 62 directly to the branch selector box 50 (bypassing the valve box 82). The branch selector box 48, its associated valve box 82, and the reheat coil 64 may be piped in a similar fashion.

The valve boxes 82 are mounted to an exterior surface of the housing 70 of the ventilation unit 26 in some embodiments, although the valve boxes 82 can be installed inside the housing 70 (space permitting) or at another location apart from the housing 70. The valve boxes 82 may include mounting features, such as mounting holes or hanger brackets, to facilitate attachment to the housing 70 or to some other surface. In FIG. 2, each electronic expansion valve 84 is shown in a separate valve box 82. In other instances, a valve box 82 may include multiple electronic expansion valves 84 connected to control refrigerant flow to different refrigerant circuits.

The EEV controller 90 includes control circuitry connected in communication with the valve boxes 82 to control operation of the electronic expansion valves 84 and flow of refrigerant to the coils 62 and 64. In FIG. 2, the EEV controller 90 includes a first printed circuit board 92 and a second printed circuit board 94 installed within a control box housing 98. The first printed circuit board 92 has control circuitry (e.g., a microcontroller) for controlling operation of the electronic expansion valve 84 connected to the dehumidifying coil 62, and a second printed circuit board 92 has control circuity (e.g., a microcontroller) for controlling operation of the electronic expansion valve 84 connected to the reheat coil 64. The EEV controller 90 may also be wired to communicate with other components of the HVAC system 10. By way of example, the EEV controller 90 may be connected to communicate with the outdoor unit 16 (e.g., with electrical control circuitry 106 of the outdoor unit 16), with the ventilation unit 26, and with the branch selector boxes 48 and 50. The EEV controller 90 can receive data from various sensors installed in the ventilation unit 26, such as temperature sensors installed to measure air temperature (incoming and outgoing) and refrigerant temperature (in gas and liquid lines at coils 62 and 64).

The first and second printed circuit boards 92 and 94 may be connected in communication with one another inside the housing 98. The EEV controller 90 can also have a communication adapter 96 (which may also be referred to as a gateway) to facilitate communication between components using different communication protocols. For instance, in one embodiment the EEV controller 90 is connected in communication with an additional controller 100 that uses a first communication protocol, such as MODBUS, that is different from a second communication protocol used by the printed circuit boards 92 and 94, such as a manufacturer's proprietary communication protocol. The communication adapter 96 can be used to translate between the different communication protocols. In one embodiment, for example, the additional controller 100 is a direct digital control (DDC) controller using the MODBUS communication protocol and the circuit boards 92 and 94 of the EEV controller 90 communicate with each other using a manufacturer's proprietary communication protocol. The communication adapter 96 translates data and command signals passing between the additional controller 100 and the circuit boards 92 and 94 to enable communication between these components.

The additional controller 100 can be connected to a building management system 102. In some cases, the building management system 102 communicates with a different protocol than the additional controller 100. Another communication gateway may be used to allow communication between the additional controller 100 and the building management system 102.

Various data or command signals may be communicated between the EEV controller 90 and the additional controller 100. In one embodiment, a technique for controlling humidity of outdoor air discharged from the ventilation unit 26 includes measuring a dew point temperature of the outdoor air downstream of the dehumidifying coil 62 and comparing the measured dew point temperature to a target dew point temperature for the outdoor air downstream of the dehumidifying coil 62. The magnitude of the difference between the measured dew point temperature and the target dew point temperature can then be reduced by sending a control signal from the EEV controller 90 (e.g., from the printed circuit board 92) to the electronic expansion valve 84 connected to the dehumidifying coil 62 to change a rate of refrigerant flow into the dehumidifying coil 62. Measuring the dew point temperature of the outdoor air downstream of the dehumidifying coil 62 may include determining the dew point temperature based on measured temperature and relative humidity downstream of the dehumidifying coil 62, which may be measured with temperature and humidity sensors downstream of the coil 62 (e.g., in the housing 70 of the ventilation unit 26).

In some cases, the additional controller 100 (e.g., a DDC controller) compares the measured dew point temperature to the target dew point temperature to determine a target dew point temperature difference, in which the target dew point temperature difference is the difference between the target dew point temperature and the current dew point temperature downstream from the dehumidifying coil 62. The additional controller 100 communicates the target dew point temperature difference to the EEV controller 90. If this difference indicates that the current heat transfer capability of the dehumidifying coil 62 is insufficient (i.e., the coil 62 is not sufficiently dehumidifying the air), the EEV controller 90 (e.g., the printed circuit board 92) sends a control signal to operate the electronic expansion valve 84 connected to the dehumidifying coil 62 to increase a rate of refrigerant flow into the dehumidifying coil 62 so as to increase the cooling capability of the coil 62 and provide further dehumidification of the air routed through the ventilation unit 26. If the target dew point temperature difference instead indicates that the current heat transfer capability of the dehumidifying coil 62 exceeds that needed to reach the target dew point temperature (i.e., the coil 62 is removing too much moisture from the air), the EEV controller 90 can send a control signal to the electronic expansion valve 84 to decrease the rate of refrigerant flow into the dehumidifying coil 62. In this example, control of the electronic expansion valve 84 by the EEV controller 90 is based on the target dew point temperature difference provided from the additional controller 100; the EEV controller 90 does not need to know the temperature between the dehumidifying coil 62 and the reheat coil 64. Further, in at least some instances, the target dew point temperature difference is calculated using sensors already installed in the ventilation unit 26 (e.g., by the manufacturer) without the addition of extra sensors.

In another embodiment, a technique for controlling a blowout temperature of the ventilation unit 26 (i.e., the temperature of air discharged from the ventilation unit 26) includes both controlling a heat exchanging capacity of the outdoor unit 16 and controlling a heat exchanging capacity of the dehumidifying coil 62. The heat exchanging capacity of the outdoor unit 16 is controlled by changing an evaporation temperature of the refrigerant toward a target evaporation temperature, or by changing a condensation temperature of the refrigerant toward a target condensation temperature, through changing an operating speed of the compressor 36. This may be referred to as evaporation temperature/condensation temperature control. The heat exchanging capacity of the dehumidifying coil 62 is controlled through operation of an electronic expansion valve 84 to change an amount of superheating of the refrigerant by the dehumidifying coil 62 or an amount of supercooling of the refrigerant by the dehumidifying coil 62; the heat exchanging capacity of the reheat coil 64 is controlled through operation of an electronic expansion valve 84 to change an amount of supercooling of the refrigerant by the reheat coil 64. This may be referred to as subcool/superheat control. In at least one embodiment, when reducing a heat exchanging capacity, the HVAC system 10 first tries to perform evaporation temperature/condensation temperature control to reduce the rotational speed of the compressor 36 efficiently. If evaporation temperature/condensation temperature control does not sufficiently reduce the capacity, the HVAC system 10 may change to subcool/superheat control, such as raising the subcool or superheat (e.g., by operating an electronic expansion valve 84 to reduce refrigerant flow through the coil 62) to decrease the heat exchanging capacity of the dehumidifying coil 62.

Figure 3:
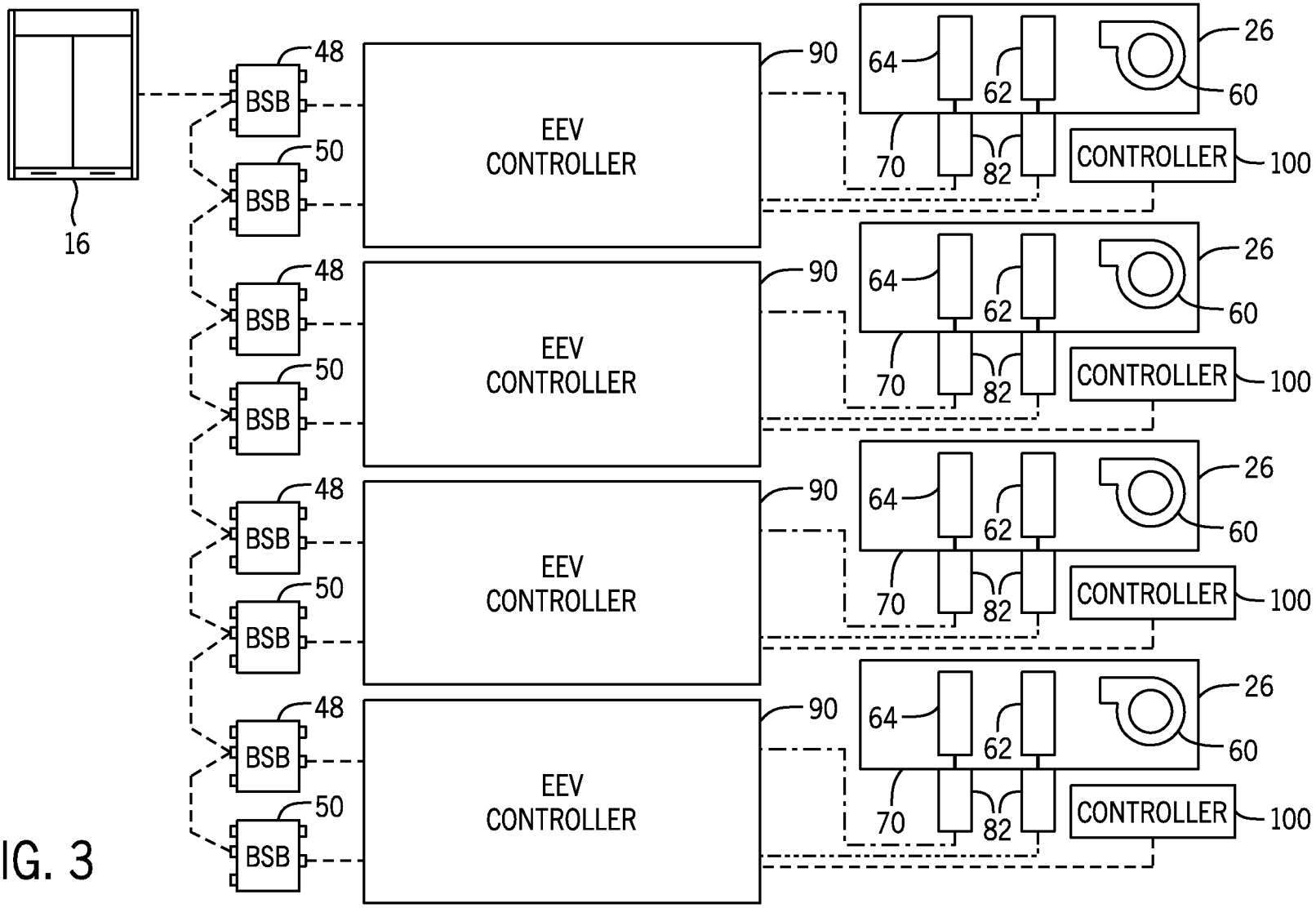
FIG. 3 generally depicts an HVAC system having multiple electronic expansion valve controllers and electronic expansion valves for controlling refrigerant flow to heat exchangers of several ventilation units in accordance with one embodiment.

While a single EEV controller 90 is depicted in FIG. 2, the HVAC system 10 may include multiple EEV controllers 90 in other embodiments. As shown in FIG. 3, for instance, an HVAC system includes four EEV controllers 90 to enable integration of four ventilation units 26 with an outdoor unit 16. Any other suitable numbers of EEV controllers 90 and ventilation units 26 may be used in other embodiments. The EEV controllers 90 enable use of an outdoor unit 16 from one manufacturer with ventilation units 26 from one or more other manufacturers, as discussed above. Examples of communication pathways between the components are depicted by dashed lines in FIG. 3. While refrigerant lines between the components have been omitted from FIG. 3 for clarity, the components may be connected by refrigerant lines in a manner like that discussed above for FIG. 2. That is, the outdoor unit 16 may provide refrigerant to the depicted branch selector boxes 48 and 50, and each pair of branch selector boxes 48 and 50 can be connected to the coils 62 and 64 of a ventilation unit 26 through expansion valves 84 in valve boxes 82. Each EEV controller 90 and associated ventilation unit 26 may be operated as described above. In this example, each EEV controller 90 receives control input from a different additional controller 100 (e.g., a DDC controller).

Figure 4:
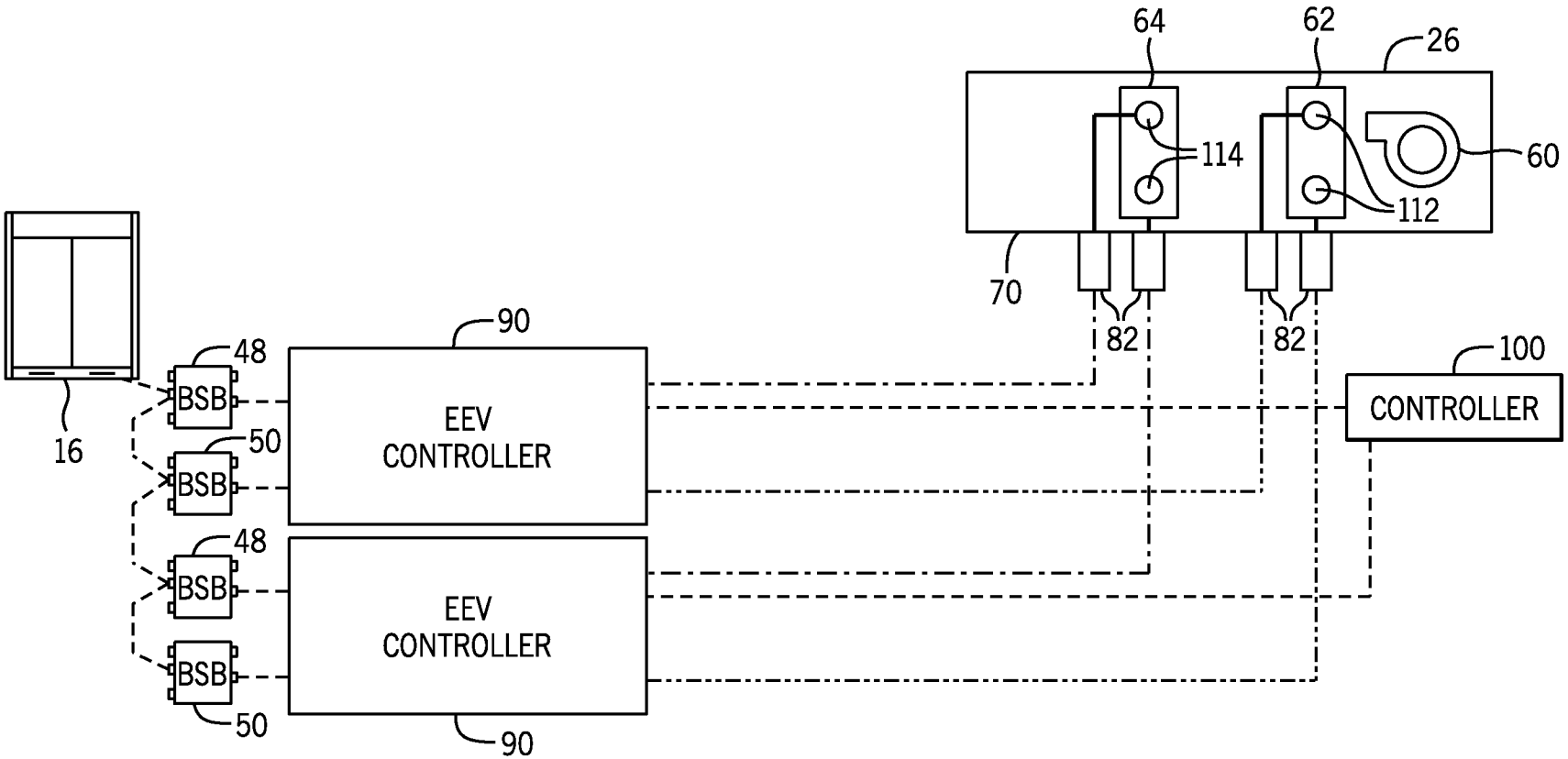
FIG. 4 generally depicts an HVAC system having multiple electronic expansion valve controllers and electronic expansion valves for controlling refrigerant flow to multi-circuit heat exchangers of a ventilation unit in accordance with one embodiment.

Another embodiment of an HVAC system having multiple EEV controllers 90 is shown in FIG. 4. This embodiment is similar to those shown in FIGS. 2 and 3 but includes a large-capacity ventilation unit 26, in which each of the dehumidifying coil 62 and the reheat coil 64 is a multi-circuit coil. The dehumidifying coil 62 includes two refrigerant circuits 112 that are independent of one another (i.e., not in fluid communication with each other) within the coil 62, and the reheat coil 64 includes two refrigerant circuits 114 that are independent of one another within the coil 64. Each of these circuits 112 and 114 is connected to a different valve box 82 (and expansion valve 84) outside the housing 70 of the ventilation unit 26. The EEV controllers 90 control refrigerant flow from the branch selector boxes 48 and 50 into the refrigerant circuits 112 and 114 through operation of the expansion valves 84, as discussed above. More specifically, one of the EEV controllers 90 is connected to control operation of two electronic expansion valves 84 to regulate flow to one refrigerant circuit 112 and to one refrigerant circuit 114, while the other EEV controller 90 is connected to control operation of two additional electronic expansion valves 84 to regulate flow to the other refrigerant circuit 112 and the other refrigerant circuit 114. As also shown in FIG. 4, a single additional controller 100 (e.g., a DDC controller) may be connected to send similar control information to multiple EEV controllers 90 to facilitate control of the large-capacity ventilation unit 26.

Figure 5:
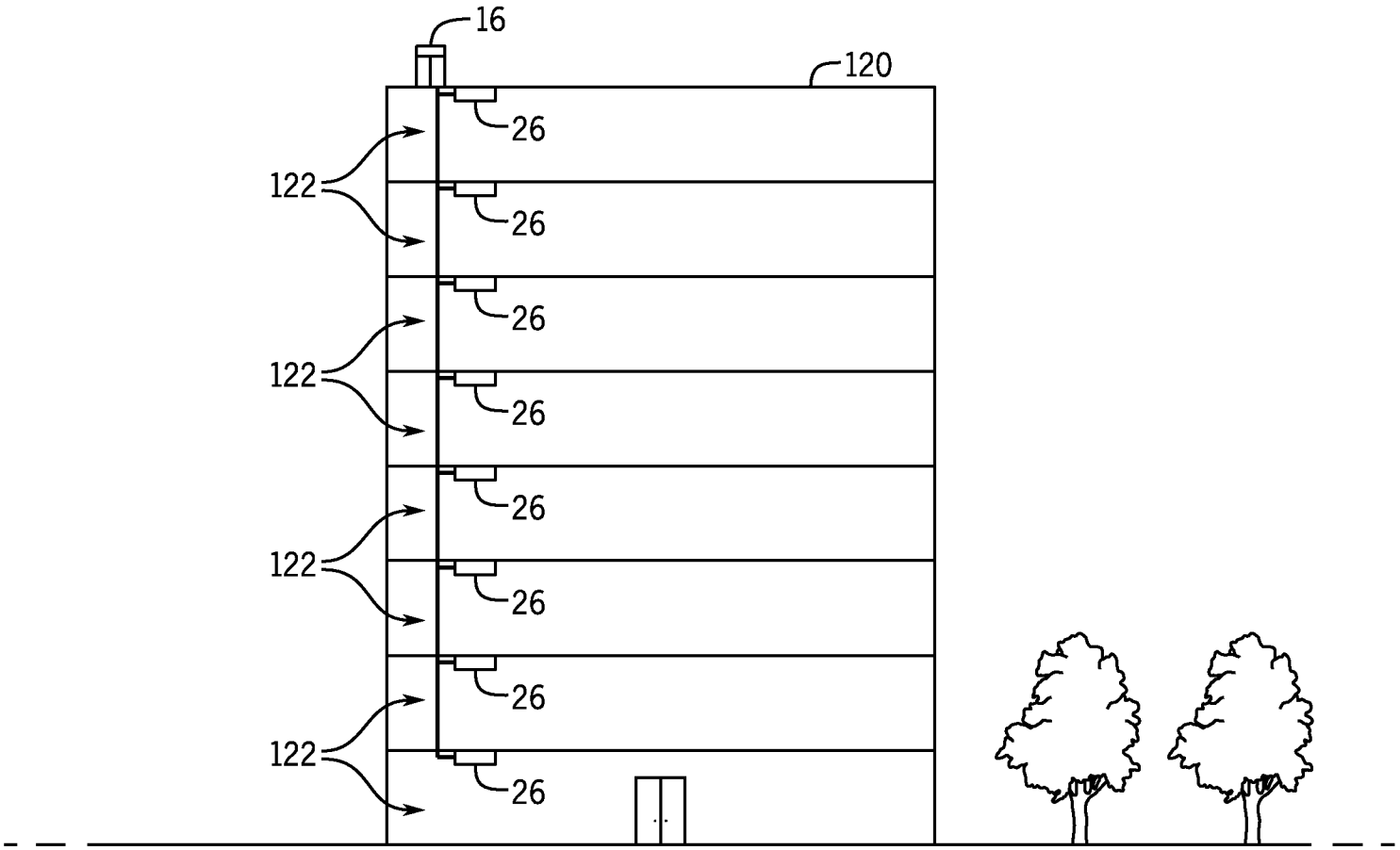
FIG. 5 generally depicts a high-rise building having an HVAC system with indoor ventilation units in accordance with one embodiment.

In some instances, the HVAC system 10 can include decentralized ventilation with multiple ventilation units 26 to provide outdoor air to a structure. By way of example, FIG. 5 generally depicts a high-rise structure 120 having ventilation units 26 providing outdoor air to indoor spaces 122 (e.g., floors). The ventilation units 26 can be located indoors, such as in void spaces above ceilings on each floor. The ventilation units 26 may receive outdoor air in any suitable manner, such as through ductwork or vents. As discussed above, outdoor air may be drawn into the ventilation units 26 via the blower 60, passed across the dehumidifying coil 62 and reheat coil 64, and then discharged into the indoor spaces 122. Further, operation of the ventilation units 26 may be performed in the manner described above, including the use of EEV controllers 90 and electronic expansion valves 84 to integrate the ventilation units 26 of one or more manufacturers with an outdoor unit 16 from another manufacturer.

Figure 6:
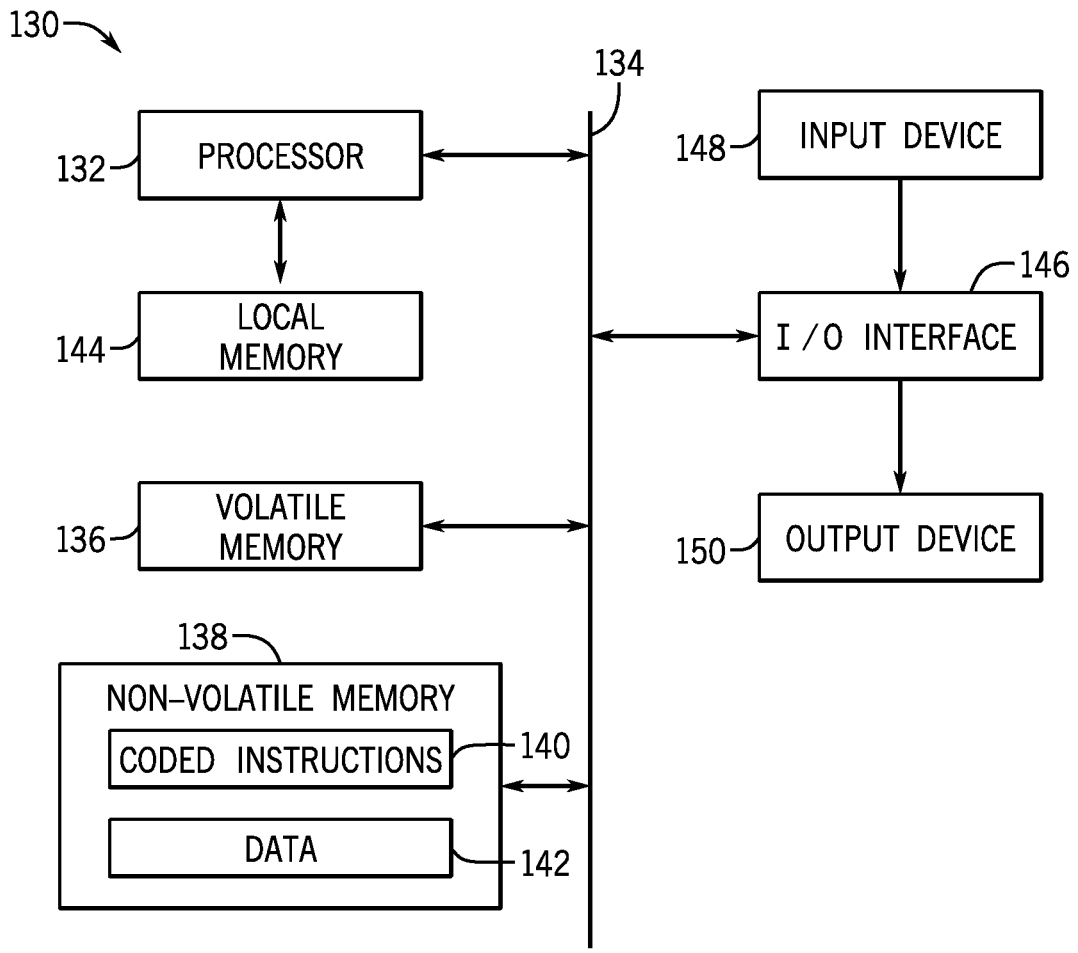
FIG. 6 is a block diagram of components of a controller for operating electronic expansion valves or other HVAC components in accordance with one embodiment.

Finally, those skilled in the art will appreciate that a processor-based controller can be programmed to facilitate performance of the above-described processes. By way of example, the printed circuit boards 92 and 94 of the EEV controller 90 and the additional controller 100 may include a processor-based controller. One example of such a controller 130 is generally depicted in FIG. 6 in accordance with one embodiment. In this example, the controller 130 includes a processor 132 connected via a bus 134 to volatile memory 136 (e.g., random-access memory) and non-volatile memory 138 (e.g., flash memory or read-only memory (ROM)). Coded application instructions 140 and data 142 are stored in the non-volatile memory 138. The instructions 140 and the data 142 may also be loaded into the volatile memory 136 (or in a local memory 144 of the processor) as desired, such as to reduce latency and increase operating efficiency of the controller 130. The coded application instructions 140 can be provided as software that may be executed by the processor 132 to enable various functionalities described herein. Non-limiting examples of these functionalities include monitoring and controlling operation of an HVAC system and components, such as controlling electronic expansion valves to regulate refrigerant flow into heat exchangers of a ventilation unit for dehumidification and reheating of air. In at least some embodiments, the application instructions 140 are encoded in a non-transitory computer readable storage medium, such as the volatile memory 136, the non-volatile memory 138, the local memory 144, or a portable storage device (e.g., a flash drive or memory card).

An interface 146 of the controller 130 enables communication between the processor 132 and various input devices 148 and output devices 150. The interface 146 can include any suitable device that enables this communication, such as a modem or serial port. In some embodiments in which the controller 130 is part of the EEV controller 90, the additional controller 100, or some other component of the HVAC system 10, the input devices 148 can include sensors, other HVAC components, and user-input devices, and the output devices 150 can include displays, lights, and other HVAC components.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An HVAC system comprising:

an outdoor unit having a compressor and a heat exchanger;

a ventilation unit configured to receive and provide outdoor air to a structure, the ventilation unit including: a blower; a dehumidifying coil to dehumidify the outdoor air received by the ventilation unit; a reheat coil to warm the outdoor air dehumidified by the dehumidifying coil; and a housing in which the blower, the dehumidifying coil, and the reheat coil are installed;

a first electronic expansion valve coupled outside the housing of the ventilation unit to control refrigerant flow into the dehumidifying coil;

a second electronic expansion valve coupled outside the housing of the ventilation unit to control refrigerant flow into the reheat coil; and an electronic expansion valve controller connected to control operation of the first electronic expansion valve and the second electronic expansion valve.

2. The HVAC system of claim 1, wherein the electronic expansion valve controller includes a first printed circuit board connected to control operation of the first electronic expansion valve and a second printed circuit board connected to control operation of the second electronic expansion valve.

3. The HVAC system of claim 1, wherein the ventilation unit is a dedicated outdoor-air system air handler unit.

4. The HVAC system of claim 3, wherein the dedicated outdoor-air system air handler unit is installed inside the structure.

5. The HVAC system of claim 1, wherein the outdoor unit includes a variable refrigerant flow outdoor unit.

6. The HVAC system of claim 1, comprising a ductless indoor unit to condition air in the structure.

7. The HVAC system of claim 6, wherein the outdoor unit is coupled to provide refrigerant to the ductless indoor unit and to the ventilation unit.

8. The HVAC system of claim 1, wherein the outdoor unit and the ventilation unit are from different manufacturers.

9. The HVAC system of claim 1, comprising an additional controller.

10. The HVAC system of claim 9, wherein the electronic expansion valve controller includes a communication adapter for translating a communication protocol used by the additional controller to a different communication protocol.

11. The HVAC system of claim 1, wherein each of the dehumidifying coil and the reheat coil is a multi-circuit coil that includes a first refrigerant circuit and a second refrigerant circuit that are independent of one another within the multi-circuit coil.

12. The HVAC system of claim 11, comprising a third electronic expansion valve and a fourth electronic expansion valve, wherein:

the first electronic expansion valve is coupled outside the housing of the ventilation unit to control refrigerant flow into the first refrigerant circuit of the dehumidifying coil;

the second electronic expansion valve is coupled outside the housing of the ventilation unit to control refrigerant flow into the first refrigerant circuit of the reheat coil;

the third electronic expansion valve is coupled outside the housing of the ventilation unit to control refrigerant flow into the second refrigerant circuit of the dehumidifying coil; and the fourth electronic expansion valve is coupled outside the housing of the ventilation unit to control refrigerant flow into the second refrigerant circuit of the reheat coil.

13. The HVAC system of claim 12, comprising an additional electronic expansion valve controller connected to control operation of the third electronic expansion valve and the fourth electronic expansion valve.

14. The HVAC system of claim 13, comprising a further controller connected to send HVAC system control information to both the electronic expansion valve controller and to the additional electronic expansion valve controller.

15. An HVAC apparatus comprising:

an expansion valve adapter kit to integrate a ventilation unit with an outdoor unit in an HVAC system, the expansion valve adapter kit including:

a first electronic expansion valve to control refrigerant flow from the outdoor unit and through a first refrigerant circuit that includes a dehumidifying coil of the ventilation unit, wherein the first electronic expansion valve is installed in a valve box that is distinct from a housing of the ventilation unit;

a second electronic expansion valve to control refrigerant flow from the outdoor unit and through a second refrigerant circuit that is independent of the first refrigerant circuit and includes a reheat coil of the ventilation unit; and an electronic expansion valve controller connected to control operation of the first electronic expansion valve and the second electronic expansion valve.

16. The HVAC apparatus of claim 15, wherein the second electronic expansion valve is installed in an additional valve box that is distinct from the housing of the ventilation unit.

17. The HVAC apparatus of claim 15, wherein the valve box is constructed to facilitate mounting of the valve box to an exterior of the housing of the ventilation unit.

18. A method of operating an HVAC system having an outdoor unit, a ventilation unit, and refrigerant lines to route refrigerant between the outdoor unit and the ventilation unit, the method comprising:

operating the HVAC system to provide outdoor air from the ventilation unit to a structure, wherein the outdoor unit includes a compressor and a heat exchanger, and the ventilation unit includes: a blower; a dehumidifying coil to dehumidify the outdoor air received by the ventilation unit; a reheat coil to warm the outdoor air dehumidified by the dehumidifying coil; and a housing in which the blower, the dehumidifying coil, and the reheat coil are installed;

controlling operation of a first electronic expansion valve coupled outside the housing of the ventilation unit to control refrigerant flow into the dehumidifying coil; and controlling operation of a second electronic expansion valve coupled outside the housing of the ventilation unit to control refrigerant flow into the reheat coil.

19. The method of claim 18, comprising controlling a blowout temperature of the ventilation unit, wherein controlling the blowout temperature of the ventilation unit includes:

controlling a heat exchanging capacity of the outdoor unit by changing an evaporation temperature of the refrigerant toward a target evaporation temperature, or by changing a condensation temperature of the refrigerant toward a target condensation temperature, through changing an operating speed of the compressor; and controlling a heat exchanging capacity of the dehumidifying coil by controlling operation of the first electronic expansion valve outside the housing of the ventilation unit to change an amount of superheating of the refrigerant by the dehumidifying coil or an amount of supercooling of the refrigerant by the dehumidifying coil.

20. The method of claim 19, comprising controlling a heat exchanging capacity of the reheat coil by controlling operation of the second electronic expansion valve outside the housing of the ventilation unit to change an amount of supercooling of the refrigerant by the reheat coil.

21. The method of claim 18, comprising controlling humidity of the outdoor air provided from the ventilation unit to the structure, wherein controlling humidity of the outdoor air includes:

determining a dew point temperature of the outdoor air downstream of the dehumidifying coil;

comparing the determined dew point temperature to a target dew point temperature for the outdoor air downstream of the dehumidifying coil; and reducing magnitude of a difference between the determined dew point temperature and the target dew point temperature by sending a control signal from an electronic expansion valve controller outside the housing of the ventilation unit to the first electronic expansion valve outside the housing of the ventilation unit to change a rate of refrigerant flow into the dehumidifying coil.

22. The method of claim 21, wherein comparing the determined dew point temperature to the target dew point temperature for the outdoor air downstream of the dehumidifying coil is performed by an additional controller that is in communication with the electronic expansion valve controller.

* * * * *